United States Patent [19]

Shimizu et al.

[11] 4,250,780

[45] Feb. 17, 1981

[54] CUTTER BLADE RECEIVING MEMBER IN A PRINTER

[75] Inventors: Munetaka Shimizu; Hiroyuki Harada, both of Kawagoe, Japan

[73] Assignee: Copal Company Limited, Tokyo, Japan

[21] Appl. No.: 954,283

[22] Filed: Oct. 24, 1978

[30] Foreign Application Priority Data

Dec. 29, 1977 [JP] Japan ..... 52/176771[U]

[51] Int. Cl.[3] ..... B41F 13/54; B41J 11/70

[52] U.S. Cl. ..... 83/176; 83/20; 83/697; 400/621; 101/226

[58] Field of Search ..... 83/20, 21, 697, 176; 400/621; 101/226

[56] References Cited

U.S. PATENT DOCUMENTS

| | | | |
|---|---|---|---|
| 3,237,494 | 3/1966 | Norvelle | 400/621 |
| 3,280,955 | 10/1966 | Brown | 400/621 |
| 3,307,674 | 3/1967 | Massen et al. | 400/621 |
| 3,485,335 | 12/1969 | McMahan | 400/621 |

*Primary Examiner*—William Pieprz

*Attorney, Agent, or Firm*—Oblon, Fisher, Spivak, McClelland & Maier

[57] ABSTRACT

A cutter blade receiving member having a slit therein for cooperating with the cutter device in a printer. The cutter blade receiving member is reduced in thickness in a portion above the slit so as to form a step on the side of the receiving member where the cutter blade of the cutter device enters the slit.

3 Claims, 5 Drawing Figures

CUTTER BLADE RECEIVING MEMBER IN A PRINTER

BACKGROUND OF THE INVENTION

This invention relates to a cutter blade receiving member having a slit adapted to cooperate with the cutter device in a printer for cutting a printing paper after a predetermined printing operation has been performed on the paper.

There have been proposed and practically employed a variety of cutter devices and cutter blade receiving members having slits for cooperating with the cutter blades of the cutter devices to cut printing papers. In most of the prior art cutter devices and cooperating cutter blade receiving members having slits, a printing paper is paid out of a printing paper supply roll, printed with desired informations at predetermined actions thereof in succession and then cut at points between the printed paper sections in succession.

However, in any one of the prior art cutter blade receiving members, when the cutter blade of the cutter device advances into the slit in the cutter receiving member to cut the paper, sagging portions are formed in the paper as the cutter blade enters the slit, the sagging paper portions follow the advancing movement of the cutter blade and therefore even after the cutter blade has retracted out of the slit, the sagging paper portions remain in the slit. As a result, as the paper is fed after the cutter blade has retracted out of the slit, the sagging paper portion or portions emerge out of the end of the slit in the cutter blade receiving member opposite from the slit end where the cutter blade enters to thereby make it difficult to feed the paper properly.

SUMMARY OF THE INVENTION

Therefore, the purpose of the present invention is to provide an improved and simplified construction of a slitted cutter blade receiving member for cooperating with the cutter device in a printer which can effectively eliminate the disadvantage inherent in the conventional cutter blade receiving members of the above-mentioned type and assures positive paper cutting and feeding.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

DETAILED DESCRIPTION OF THE PREFERRED EMBODIMENT OF THE INVENTION

Figure 1:
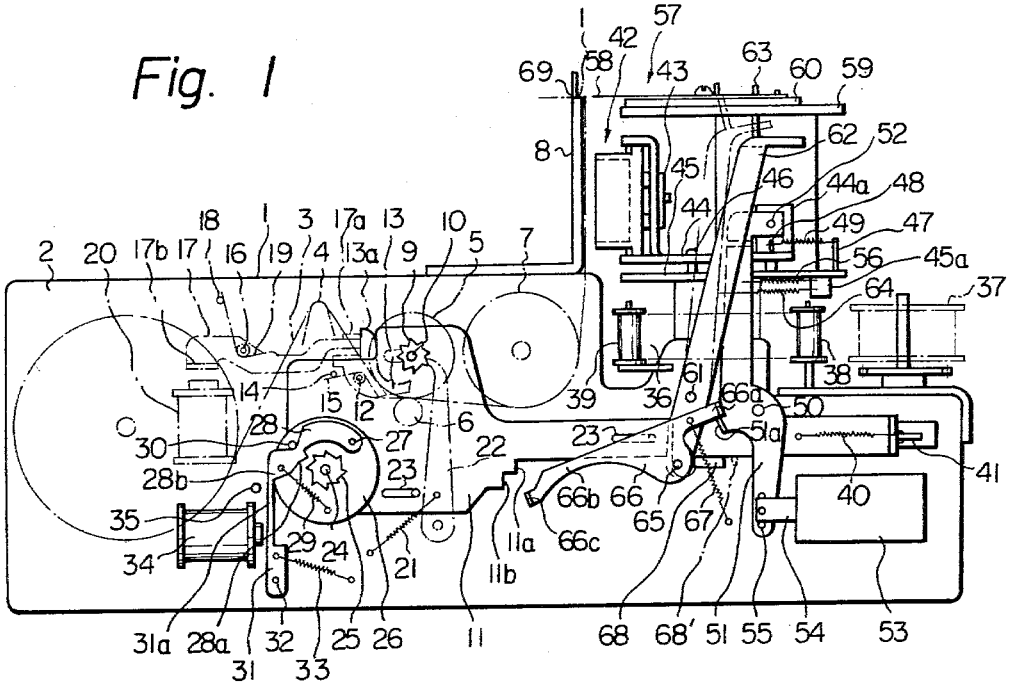
FIG. 1 is a side elevational view of a printer in which the present invention is incorporated.

The present invention will be now described referring to the accompanying drawings and more particularly, to FIG. 1 in which a printer incorporating the present invention is shown. The printer generally comprises a main body 1 in which a printing paper 5 is paid out of a printing paper supply roll 2 and guided about a guide 4. From the guide 4, the paper 3 is advanced through the nip between a paper feed roller 5 and a press roller 6 to a printing wheel 7 bearing a plurality of printing character types in the outer periphery. In printing, a desired printing character type is selected out of the plurality of printing character types on the printing wheel 7 in accordance with a command from a control circuit (not shown) associated with the printer and a printing hammer (not shown) is actuated to print the character born by the selected printing character type on the paper with an inked ribbon (not shown) interposed between the paper and the periphery of the printing wheel in the manner as will be described hereinafter. After the printing operation, the paper is guided along a cutter blade receiving member 8 to be discharged out of the printer.

The paper feed roller 5 is fixedly secured to a transverse shaft 10 which is in turn rotatably supported on the main body 1 by means of suitable support means (not shown) and which also has a ratchet gear 9 secured thereto. A slide lever 11 is provided so as to reciprocally move in a horizontal plane in timed relationship to the printing operation by the printing wheel 7 in the manner as will be described hereinafter and has a stub shaft 12 secured to and laterally projecting from the slide lever 11 and having a ratchet paw lever 13 pivoted thereto. After the printing operation, the ratchet pawl lever 13 is pivoted to engage the ratchet gear 9 to rotate the feed roller 5 in cooperation with the gear. More particularly, in the feeding of the paper 3, the ratchet pawl lever 13 is urged in the counter-clockwise direction (as seen in FIG. 1) to engage the ratchet gear 9 by menas of a spring 15 having one end anchored to a pin 14 which serves as a limit pin and the other end anchored to the ratchet pawl lever 13 and wound about the stub shaft 12 in the intermediate portion between the ends of the spring. The ratchet pawl lever 13 is normally held away from the ratchet gear 9 by the engagement of the upwardly extending arm **13*a* on the lever 13 with an arm 17*a* on a paper feed lever 17 pivoted to a stub shaft 16 which is in turn suitably supported on the main body 1. The paper feed lever 17 is normally urged in the clockwise direction or in the direction urging the ratchet pawl lever 13 away from the ratchet gear 9 by means of a spring 19 having one end anchored to a pin 18 on the main body 1 and the other end anchored to the paper feed lever 17. The paper feed lever 17 further has a second arm 17*b* formed of magnetic material and cooperating with an electromagnetic solenoid 20 in such a manner that as the slide lever 11 is moved rightwards from the illustrated position in the horizontal plane after the printing operation, the solenoid 20 is periodically energized by the control circuit whereby the second arm 17*b* of the paper feed lever 17 is magnetized by the energized solenoid and the paper feed lever 17 is magnetically attracted by the solenoid to rock in the counter-clockwise direction whereupon the first arm 17***a* of the feed lever 17 disengages from the arm 13*a* of the ratchet pawl lever 13 and the spring 15 acts to cause the ratchet paw lever 13 to engage the ratchet gear 9. Thus, it will be seen that the rightward movement of the slide lever 11 causes the ratchet lever 13 which is now engaged with the ratchet gear 9 to rotate the gear and accordingly, the paper feed roller 5 in turn feeds the paper 3 pinched between the feed roller 5 and press roller 6 by a predetermined increment. A detent lever 22 is suitably pivoted to the main body 1 and normally urged in the couter-clockwise direction. The detent lever 22 engages the ratchet gear 9 to prevent the gear from rotating in the reverse direction. When the solenoid 20 is deenergized, the paper feed lever 17 is rocked in the clockwise direction under the action of the spring 19 so as to release the ratchet pawl lever 13 from its engagement with the ratchet gear 9. In order to limit the rotation of the ratchet lever 13 in the counter clockwise direction beyond a predetermined amount, a limit pin 14 is provided.

The above-mentioned slide lever 11 is supported on the main body 1 for reciprocal movement in a horizontal plane by means of a pin-slot type guide arrangement 23. As the slide lever 11 makes one reciprocal movement in the horizontal plane in which the lever moves rightwards and then leftwards with respect to the illustrated position of the lever, the paper cutting or perforating operation is selectively performed on the printing paper and the inked ribbon feeding is also performed in the manner as will be described hereinafter.

For the purpose, a transverse shaft 24 is rotatably supported on the main body 1 to be rotated by a motor (not shown) during the operation of the printer and a ratchet gear 25 is fixedly mounted on the shaft 24. The shaft 24 also has a slide lever drive cam disc 26 rotatably mounted thereon and the cam disc has an eccentric cam (not shown) integrally secured thereto. The eccentric cam is received in a vertically elongated slot (not shown) formed in the slide lever 11 so that as the cam disc 26 is rotated from the illustrated position in the counter-clockwise direction to make one complete revolution, the slide lever 11 makes one reciprocal movement in which the lever is moved rightwards from the illustrated position by the amount corresponding to the eccentric amount of the eccentric cam and then returns to the illustrated or initial position.

In order to attain one complete revolution of the above-mentioned cam disc 26, a ratchet pawl lever 28 is pivoted to the cam disc 26 by means of a pivot pin 27 and urged towards the axis of the cam disc 26 by means of a spring 29 and the pivotal movement of the ratchet pawl lever 28 away from the axis of the cam disc 26 is limited by a limit pin 30 on the cam disc 26. With the ratchet pawl lever 28 in this position engaged by the limit pin 30, the pawl 28*a* on the ratchet pawl lever 28 is out of engagement with the ratchet gear 25 and accordingly, the cam disc 26 remains stationary. In order to retain the ratchet pawl lever 28 in this position and hold the cam disc 26 stationary, an engaging lever 31 is provided. The engaging lever 31 is pivoted to the main body 1 by means of a pin 32 and urged in the clockwise direction by a spring 33 so as to cause the free end of the arm 31*a* on the lever 31 to frictionally engage the outer periphery of the cam disc 26 to be held thereby and also engages the leading end 28*b* of the ratchet pawl lever 28 so as to hold the ratchet pawl lever 28 in engagement with the limit pin 30 and disengages the lever 28 from engagement with the ratchet gear 25 to thereby hold the cam disc 26 stationary. In this position of the cam disc 26, the eccentric cam holds the slide lever 11 in a position leftwardly of the illustrated position.

The arm 31*a* of the engaging lever 31 is made of a material to be magnetically activated to cooperate with an electromagnetic solenoid 34. Thus, when the solenoid 34 is energized by the control circuit in times relationship to the termination of the printing operation of the printer, the engaging lever 31 is magnetically attracted by the energized solenoid 34 to rock in the counter-clockwise direction until the lever is abutted by the limit switch. With the engaging lever 31 in this position, the free end of the arm 31*a* of the lever 31 is out of engagement with the leading end 28*b* of the ratchet pawl lever 28 to allow the ratchet pawl lever 28 to rock in the clockwise direction under the action of the spring 29 until the ratchet pawl 28*a* of the ratchet pawl lever 28 engages the continuously rotating ratchet gear 25 whereby the cam disc 26 is rotated together with the ratchet pawl lever 28 so as to move the slide lever 11 rightwards under the action of the eccentric cam in the manner as described hereinabove. Immediately after the attraction of the engaging lever 31 thereto, the solenoid 34 is deenergized whereupon the engaging lever 31 is returned under the action of the spring 33 to the position in which the lever 31 is frictionally engages the outer periphery of the cam disc 26. Thus, when the slide lever 11 has made one reciprocal movement as the cam disc 26 makes one complete revolution, the ratchet pawl 28*a* of the ratchet pawl lever 28 again abuts against the free end of the arm 31*a* of the engaging pawl lever 31 whereby the ratchet pawl lever 28 is rocked to the position in which the ratchet pawl lever 28 is engaged by the limit pin 30 to disengage the ratchet pawl 28*a* of the ratchet pawl lever 28 from the ratchet gear 25 to thereby hold the cam disc 26 stationary at the end of the above-mentioned one complete revolution.

The above-mentioned inked ribbon 36 is paid out of the ribbon roll on an inked ribbon supply reel 37 and guided about guide rollers 38, 39 in proximate relationship to the printing wheel 7 to be wound about an inked ribbon take-up reel (not shown) positioned in symmetrical relationship to the reel 37. After a predetermined amount of the inked ribbon 36 has been wound about the take-up reel, a shift means (not shown) is actuated to reverse the movement direction of the inked ribbon 36 and the ribbon is rewound about the supply reel 37. The alternate winding of the inked ribbon 36 is repeated between the supply reel and take-up reel in this way. In order to drive the two reels, an operation member 41 is connected to the right-hand end of the slide lever 11 (as seen in FIG. 1) by means of a spring 40 and actuated in relation to the reciprocal movement of the slide lever 11 to feed the inked ribbon. However, since the drive arrangement of the reels does not constitute any part of the present invention, the drive arrangement will not be in detail described herein.

Before explaining the selective paper cutting and perforating operations which are performed in relation to the reciprocal movement of the slide lever 11, description will be made of a predetermined sequence of stamping printing to be performed on the printing paper 3 prior to the selective paper cutting and perforating operations.

The above-mentioned printer is designed to be used for printing characters on bills to be delivered to customers as receipts at shops or stores and in order to make it possible to print advertisement materials on the bills other than the necessary characters without actuating the printer, according to the present invention, a stamping means 42 is provided.

The stamping means 42 is supported on a L-shaped holder 44 which holds a support member 43 which in turn movably supports the stamping means 42 in such a manner that the stamping means 42 is caused to abut against the entire front surface of the cutter blade receiving member 8 with a uniform pressure with the printing paper 3 interposed therebetween for stamping and the holder 44 is guided for reciprocal movement in a horizontal plane as a guide pin 46 on a guide member 45 secured to the main body 1 slidably moves within an elongated slot (not shown) formed in the holder 44. The holder 44 is normally urged to the retreated position by means of a spring 49 anchored at the opposite ends to a pin 47 on the guide member 45 and a pin 48 on the holder 44, respectively, whereby the stamping means is held away from the cutter blade receiving member 8.

The holder 44 is formed at the rear end with a bent piece **44*a* extending upwardly therefrom and the bent piece is connected through a spring or the like (not shown) to a pin 52 at the upper end of a stamping means operation lever 51 pivoted to the main body 1 by means of a pivot pin 50. Thus, as the stamping means operation lever 51 is rocked in the counter-clockwise direction, the holder 44 and according, the stamping means 42 supported on the holder is advanced through the spring until the stamping means abut against the cutter blade receiving member 8 with a suitable pressure provided by the spring to thereby perform stamping on the paper 3**.

The lower end of the stamping means operation lever 51 is pivotally connected to the plunger 54 of an electromagnetic solenoid 53 mounted on the main body 1 by means of a pin slot arrangement 55 and normally urged in the clockwise direction by means of a spring 56 anchored at the opposite ends to a bent piece **45*a* depending from the rear end of the guide member 45 and the pivot pin 50 for the stamping means operation lever 51, respectively, to thereby hold the stamping means 42 in the retracted position. However, when the solenoid 53 is energized by the control circuit while the paper 3 is being held stationary after a predetermined printing operation on the paper has been completed by the printer, the plunger 54 is magnetically attracted by the energized solenoid 53 to rock the operation lever 51** in the counter-clockwise direction to thereby perform the above-mentioned stamping on the paper.

The above-mentioned printer is provided with a cutter device 57 which is adapted to cut sections of the printing paper 3 where desired characters and advertisements materials have been printed and stamped off the remaining portion of the paper at the completion of the printing and stamping operations and also provide perforated lines at the areas of the paper positioned between the printed stamped paper sections so that the processed paper sections can be torn along the perforated lines off the remaining portion of the paper for processing at stores or shops later. The cutter device 57 and stamping means 42 are selectively and cooperatively actuated in relation to the operations of the slide lever 11 and electromagnetic solenoid 53, respectively so that when the stamping means 42 is actuated to perform stamping on the paper 3, the cutter device 57 is actuated to perform cutting on the paper and thereafter, when the paper has been fed by a predetermined increment, the cutter device 57 performs perforating on the paper while the stamping means 42 remains inoperative after the printer has performed a predetermined printing operation.

For the purpose, a shift lever (not shown) is provided for cooperation with the stamping means holder 44 and cutter holder 60. When the shift lever is actuated for selective shifting operation by an electrostatic solenoid. When the electromagnetic solenoid associated with the shift lever is energized, the solenoid allows the stamping means 42 and the cutter device 57 to perform stamping and cutting, respectively, but when the electromagnetic solenoid is rendered to its deenergized state, the stamping means 42 is held in a position away from the guide plate 8 by the shift lever to prohibit stamping and the cutter device 57 is in turn advanced to the perforation line forming position and performs perforating without performing cutting operation.

The cutter device 57 includes a cutter holder 60 having a cutter blade 58 secured thereto and the cutter holder 60 is guided for reciprocal movement along a guide member 59 secured to the main body 1 in a horizontal plane by a predetermined amount by means of a pin-slot arrangement (not shown).

The cutter holder 60 has an engaging hole (not shown) for receiving a bent piece 63 formed at and upwardly extending from the upper end of the cutter operation lever 62 which is pivoted to the main body 1 by means of a pin 61. When the cutter lever 62 is rocked in the counter-clockwise direction, the cutter holder 60 having the cutter blade 58 secured thereto is advanced until the cutter blade enters the slit 68 in the cutter blade receiving member 8 so that the cutter blade 58 selectively performs cutting or perforating depending upon the advancing amount of the cutter blade into the slit 68.

The cutter operation lever 62 is normally urged in the clockwise direction or the direction in which the cutter blade 58 is retracted from the cutter receiving plate 8 by means of a spring 64 anchored at the opposite ends to the depending bent piece **45*a* on the guide member 45 and to the cutter operation lever 62 in a position above the pin 61, respectively, and the operation lever has at the lower end a pin 65 by means of which a slide connection lever 66 is pivoted to the cutter operation lever 62**.

The slide connector lever 66 is normally urged in the clockwise direction by means of a spring 67 anchored at the opposite ends to the slide connector lever 66 and the main body 1, respectively, so that the end of the right-hand arm **66*a* engages the bent piece 51*a* on the stamping means operation lever 51 and the end of the left-hand arm 66*b* of the lever 66 is formed with a bent piece 66*c*. The slide lever 11 is formed with a first stepped portion 11*a* and a second stepped portion 11*b* for selectively engaging the bent piece 66*c* on the slide connector lever 66**.

In the illustrated position, the arm **66*a* is engaged by the bent piece 51*a* and the bent piece 66*c* is out of the path in which the first and second stepped portions 11*a*, 11*b* act whereby the slider connector lever 66 is in its inoperative position regardless of the reciprocal movement of the slide lever 11 and the cutter operation lever 62 is not actuated whereby the cutter device 57** is held in its inoperative position.

When the electromagnetic solenoid 53 is energized and the electromagnetic solenoid associated with the above-mentioned shift lever is energized, the stamping means operation lever 51 is allowed to rock throughout its entire stroke and therefore, the stamping means operation lever 51 advances the stamping means 42 to cause the stamping means to perform stamping on the paper 3. During the rocking movement of the lever 51 throughout its entire stroke, the bent piece 51*a* moves downwardly and the slide connector lever 66 is rocked under the action of the spring 67 until the bent piece 66*c* on the slide connector lever 66 engages the first stepped portion 11*a* on the slide lever 11. Thus, as the slide lever 11 moves rightwards, the cutter operation lever 62 is allowed to rock in the counter-clockwise direction throughout its entire stroke to cause the cutter device 57 to cut printed and stamped sections of the paper off the remaining portion of the paper.

On the other hand, when the electromagnetic solenoid associated with the shift lever is in its deenergized condition, since the stamping means holder 44 and cutter holder 60 are limited in the advancing movement to the stamping blocking position and the perforating position, respectively, as mentioned hereinabove, the rocking stroke of the stamping means operation lever 51 in the counter-clockwise direction upon energization of the solenoid 53 is limited to thereby prevent stamping operation and the downward movement of the bent piece 51*a* is limited whereby the slide connector lever 66 is allowed to rock to only a limited amount to the position in which the bent piece 66*c* on the lever 66 engages the second stepped portion 11*b* on the slide lever 11 and as a result, since the second stepped portion 11*b* is positioned rearwardly of the first stepped portion 11*a* with respect to the rightward movement of the slide lever 11, the slide connector lever 66 moves rightwards by only a small amount whereby the cutter holder 66 is also limited in its advancing amount to advance the cutter blade 58 towards the paper 3 to the perforating position with respect to the paper 3 as mentioned hereinabove.

In the printer as mentioned hereinabove, the feature of the present invention lies in the improved shape of the slit 68 in the cutter receiving member 8 which cooperates with the cutter blade 58 in cutting the paper 3. The improved slit 68 can positively eliminate the disadvantage inherent in the prior art slits in the cutter blade receiving plates that when the paper is cut, the paper sags to enter deep into the slit and emerges out of the slit on the side of the receiving member opposite from the side thereof where the cutter blade enters the slit as the feeding of the paper is resumed resulting in clogging up the slit.

Figure 2:
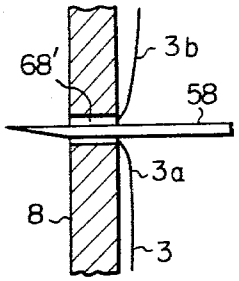
Fig. 2 (PRIOR ART)
FIG. 2 is a fragmentary cross-sectional view of one prior art cutter blade receiving member having the slit for use in conjunction with a cutter device showing the blade of the cutter device in the printer in its advanced position into the slit.
Figure 3:
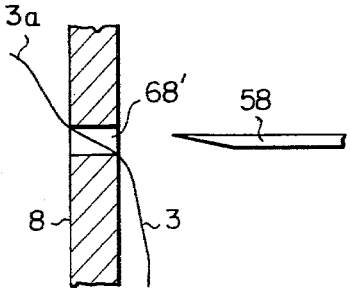
Fig. 3 (PRIOR ART)
FIG. 3 is similar to FIG. 2, but shows the cutter blade in its retracted position out of the slit.

In most of the prior art cutter devices, as shown in FIGS. 2 and 3, the cooperating cutter receiving member 8 provided with the slit 68' is flat on the opposite sides or has a uniform thickness throughout its length and therefore, when the cutter blade 58 enters to cut the paper 3, as shown in FIG. 2, sagging portions 3*a*, 3*b* are formed on the opposite sides of the point to be cut in the paper and the sagging portions follow the advancing movement of the cutter blade 58 and tend to adhere to the walls of the slit 68' whereby the sagging portions 3*a*, 3*b* remain in the slit 68' even after the cutter blade 58 has retracted from the slit 68'. Thus, as the paper 3 is fed in increment after the cutting operation, the sagging portion 3*a* emerges out of the end of the slit 68' on the side of the cutter blade receiving member opposite from the side thereof where the cutter blade 58 enters the slit 68' to thereby make it impossible to feed the paper properly.

Figure 4:
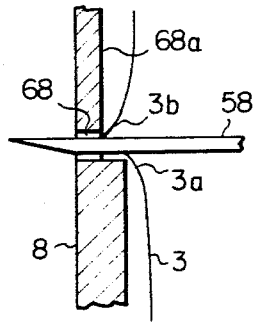
FIG. 4 is a fragmentary cross-sectional view of the cutter blade receiving member having the slit according to the present invention for use in conjunction with the cutter device in the printer as shown in FIG. 1 showing the blade of the cutter device in its advanced position into the slit.
Figure 5:
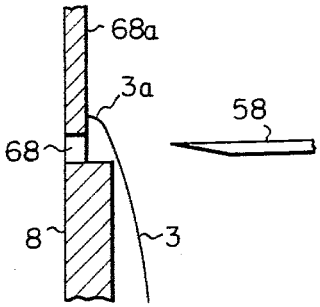
FIG. 5 is similar to FIG. 4, but shows the cutter blade in its retracted position out of the slit.

On the other hand, according to the present invention, the side of the cutter blade receiving member 8 where the cutter blade enters is stepped or more particularly, the upper portion of the blade receiving member side above the slit 68 is reduced in thickness as shown by reference numeral 68*a* as shown in FIGS. 4 and 5 whereby as the cutter blade 58 advances into the slit 68, the sagging portion 3*a* of the paper does not fully follow the advancing movement of the cutter blade 58 and terminates its movement following the advancing movement of the cutter blade short of the step 68*a* of the cutter blade receiving member 8 and as the cutter blade 58 retracts out of the slit 68, the paper sagging portion 3*a* follows the retracting movement of the cutter blade 58 and rides on the step 68*a*. Thus, as the paper 3 is subsequently fed in increment, the paper sagging portion 3*a* is positively prevented from emerging out of the end of the slit 68 on the side of the cutter blade receiving member opposite from the side of the receiving member where the cutter blade enters the slit 68 and fed upwardly along the step 68*a* as the paper is fed. In this way, the clogging of the slit 68 with the slagging paper portion can be perfectly prevented.

The present invention is applicable to any type of printer having the cutter device in addition to the illustrated printer.

While only one embodiment of the invention has been shown and described in detail, it will be understood that the same is for illustration purpose only and not to be taken as a definition of the invention, reference being had for this purpose to the appended claims.

We claim:

1. In a paper printer including a strip of thin easily deformable paper, means for moving the paper in a predetermined direction, and a cutter blade actuated by a cutter device, a cutter blade receiving member cooperating with said cutter blade, said cutter blade receiving member comprising:

a plate having a face over which said paper strip passes;

a slit on said face and into which said cutter blade is received, means moving said blade for completely penetrating and cutting said strip and passing through a portion of said plate and causing the cut ends to sag, the width of said slit exceeding that of said blade by an amount sufficient to permit said sagging to occur;

a raised portion on said face and located immediately upstream from said slit in said predetermined feeding direction, a portion integral with said cutter blade receiving member and located immediately downstream from said raised portion being of a reduced thickness relative to said raised portion so as to form a step on said face, whereby said sagging cut end does not enter said slit when moving in said predetermined direction.

2. The apparatus of claim 1, wherein said raised portion defines a surface of said cutter blade receiving member, said surface being bounded by said slit.

3. The apparatus of claim 1 wherein said means for moving said blade are adapted to move said blade through at least a substantial portion of said plate.

* * * * *